US006071105A

United States Patent [19]

Bodzak et al.

[11] Patent Number: 6,071,105

[45] Date of Patent: Jun. 6, 2000

[54] GEAR PUMP FOR FEEDING FUEL TO A FUEL INJECTION PUMP

[75] Inventors: Stanislaw Bodzak, Elsbethen; Hanspeter Mayer, Adnet, both of Austria

[73] Assignee: Robert Bosch GmbH, Stuttgart, Germany

[21] Appl. No.: 08/934,129

[22] Filed: Sep. 19, 1997

[30] Foreign Application Priority Data

Sep. 19, 1996 [DE] Germany ..... 196 38 332

[51] Int. Cl.[7] ..... F04C 2/18; F16D 1/06

[52] U.S. Cl. ..... 418/102; 418/206.1; 418/206.8; 403/375

[58] Field of Search ..... 417/310; 418/206.1, 418/206.7, 206.8, 102; 403/375, 359.1, 359.6, 365, 367

[56] References Cited

U.S. PATENT DOCUMENTS

| | | | |
|---|---|---|---|
| 2,417,084 | 3/1947 | Monroe | 418/206.1 |
| 2,672,823 | 3/1954 | Thompson et al. | 418/206.7 |
| 3,043,497 | 7/1962 | Gabbioneta | 418/102 |
| 3,105,446 | 10/1963 | Blomgren et al. | 418/206.1 |
| 3,428,344 | 2/1969 | Strange | 287/53 |
| 4,153,400 | 5/1979 | Morita | 418/102 |
| 4,392,798 | 7/1983 | Bowden | 418/102 |
| 4,902,202 | 2/1990 | Bowden | 417/310 |
| 5,391,068 | 2/1995 | Uppal | 418/206.1 |
| 5,597,291 | 1/1997 | Bodzak et al. | 417/310 |

FOREIGN PATENT DOCUMENTS

| | | | |
|---|---|---|---|
| 238205 | 10/1945 | Switzerland | 418/102 |

OTHER PUBLICATIONS

Grainger Industrial and Commercial Equipment and Supplies General Catalog No. 380, Dec. 1991.

*Primary Examiner*—John J. Vrablik
*Attorney, Agent, or Firm*—Ronald E. Greigg; Edwin E. Greigg

[57] ABSTRACT

A feed pump having a pair of gears in a housing that mesh with each other and are driven to rotate in a pump chamber. The pair of gears supply fuel from an intake chamber connected to a storage tank, along a supply conduit in the housing constituted between the end face of the gears and the circumference wall of the pump chamber, and into a pressure chamber. In order to introduce lateral forces acting on the gears directly into the pump housing the gears are each supported on a housing pin, which is embodied as being of one piece with the housing of the feed pump and protrudes into the housing.

6 Claims, 2 Drawing Sheets

GEAR PUMP FOR FEEDING FUEL TO A FUEL INJECTION PUMP

BACKGROUND OF THE INVENTION

The invention is based on a feed pump which has been disclosed by DE 44 41 505, U.S. Pat. No. 5,597,291, and is used for feeding fuel from a storage tank to a fuel injection pump of an internal combustion engine.

The feed pump is embodied as a geared feed pump which has a pair of gears that engage in an externally meshed fashion. The rotationally driven pair of gears feeds fuel from an intake chamber connected to the storage tank, along a supply conduit constituted between the end faces of the gears and the circumference wall of the pump chamber, and into a pressure chamber from which a supply line leads to the fuel injection pump.

However, the known feed pump has the disadvantage that the radial forces acting on the gears are directly transmitted as lateral forces onto the drive shaft and the axle of the driven gear so that these must be dimensioned as correspondingly large.

Furthermore, with the known feed pump, there is insufficient lubrication of the gears at their bearings so that particularly with larger gear widths, there is the danger of the lubricant being spread thin and consequently an increased frictional wear occurs.

OBJECT AND SUMMARY OF THE INVENTION

The feed pump according to the invention has the advantage over the prior art that through the support of the gears on housing bearing pins that are embodied as being of one piece with the housing, the radial or lateral forces acting on the gears due to the internal pump pressure are introduced directly into the housing of the feed pump. The drive shaft of the driving gear is consequently relieved of lateral forces and now only transmits the drive torque. In this manner, the drive shaft can be dimensioned smaller or with a design that remains the same, the possible torque and the operating strength can be significantly increased. Furthermore, a separate axle for bearing the driven gear can be eliminated, which has a positive effect on manufacture costs.

In comparison to the known feed pump, the bearing of the gears on housing pins produces an altered transmission of the torque from the drive shaft to the first gear. This transmission of rotary motion now takes place via a coupling member, which is preferably embodied as a disk. This disk can be alternatively pressed into the interior wall of the gear and connected to the drive shaft with positive engagement or can be pressed onto the drive shaft and connected to the gear with positive engagement.

It is particularly advantageous to embody the coupling member out of an elastic material and to thus prevent a transmission of vibrations and shocks as well as to produce a particular flexibility of the connection.

The coupling member pressed into the gear preferably has a central recess and a formed pin, which is correspondingly shaped and protrudes axially from the drive shaft, engages in this recess.

The coupling member pressed onto the drive shaft preferably has three radially protruding formations (pins) on the circumference, which engage with a slight amount of play in corresponding recesses in the inner diameter of the gear.

Another advantage of supporting the gears on inwardly protruding housing pins is the possibility of an improved bearing lubrication. To that end, flattenings or recesses are provided on the housing bearing pin, e.g. in the form of a round groove, in which the lubricant (preferably fuel) can collect and then easily reaches the slide bearing, wherein these flattenings are preferably disposed on the end of the housing pin remote from the pressure (intake side). A radial bore in the gear, which starting from the tooth base, feeds between two teeth into the interior wall face, furthermore improves the penetration of the lubricant into the slide bearing since the bore passes through the pressure zone (pressure chamber) with each revolution of the gear so that the lubricant is actively pressed into the slide bearing.

The feed pump according to the invention is particularly suited to be used as a fuel feed pump for delivering fuel from a storage tank to a fuel injection pump of an internal combustion engine, but can also be used to feed other fluid feed mediums.

The invention will be better understood and further objects and advantages thereof will become more apparent from the ensuing detailed description of preferred embodiments taken in conjunction with the drawings.

DESCRIPTION OF THE PREFERRED EMBODIMENTS

The feed pump according to the invention, represented in different details and views in FIGS. 1 to 10, is inserted into a supply line, not shown, from a storage tank to a fuel injection pump for internal combustion engines.

Figure 1:
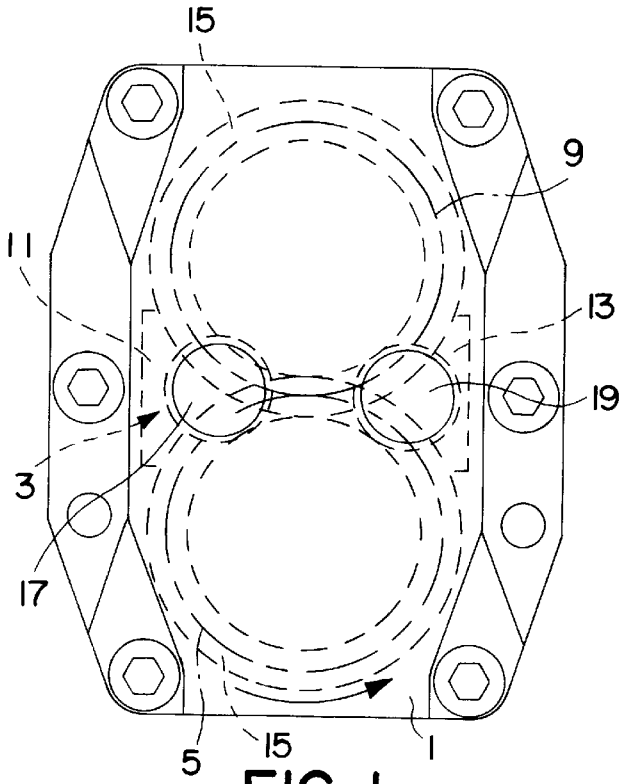
FIG. 1 is a view of the closed cover side of the feed pump with the representation of the position of the gears and the inlet and outlet openings.
Figure 3:
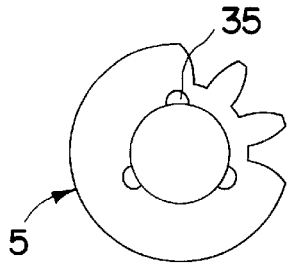
FIG. 3 is a single part representation of the first gear from FIG. 2 in a first view.
Figure 4:
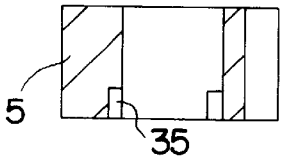
FIG. 4 is a second, sectional representation of the gear from FIG. 3.
Figure 2:
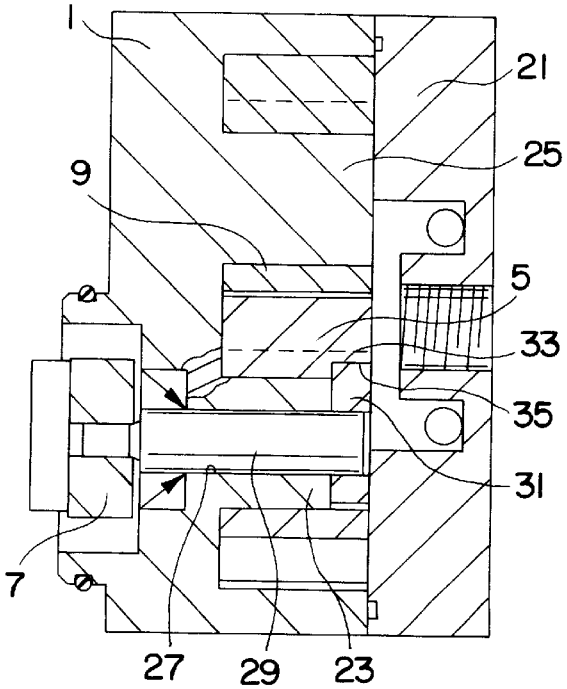
FIG. 2 is a sectional representation of the first exemplary embodiment of the feed pump, which is rotated by 90° in comparison to FIG. 1 and in which the coupling member is pressed onto the drive shaft.

The exemplary embodiment of the feed pump represented in FIGS. 1 and 2 has a pump chamber 3 in its housing 1 and a rotationally driven pair of gears that mesh with each other is disposed in this chamber.

A first gear 5, disposed on the bottom in the exemplary embodiment, is driven to rotate by means of an external drive element 7, not shown in precise detail, and transmits this rotary motion via an end face gearing to a second gear 9 that meshes with the first gear 5.

By means of their toothed engagement, the gears 5, 9 divide the pump chamber 3 into two subregions of which a first subregion constitutes an intake chamber 11 and a second part constitutes a pressure chamber 13.

The intake chamber 11 communicates with the pressure chamber 13 via the respective supply conduit 15 constituted between the tooth grooves on the end faces of the first and second gear 5, 9 and the upper and lower circumference wall of the pump chamber 3. Furthermore, the intake chamber 11 and the pressure chamber 13 each have a connection opening in the wall of the pump housing 1 via which the intake chamber 11 communicates with an intake line, not shown, from the storage tank and via which the pressure chamber 13 communicates with a supply line, likewise not shown, to the inlet chamber of the fuel injection pump. The connection opening into the intake chamber 11 constitutes an inlet opening 17 and the connection opening into the pressure chamber 13 constitutes an outlet opening 19, which are disposed in a housing cover 21 that closes the pump chamber 3.

The gears 5, 9 are supported on housing pins, which protrude into the interior of the pump housing 1 and are embodied as being of one piece with the pump housing 1. A first housing pin 23 disposed at the bottom constitutes a bearing pin that receives the first gear 5 and a second housing pin 25 disposed at the top constitutes a bearing pin that receives the second gear 9.

The first housing pin 23 has an axial through bore 27 in which a drive shaft 29 is guided, which on its end remote from the housing cover 21 is connected in a non-rotating manner to the drive element 7.

On its end remote from the drive element 7, the drive shaft 29 protrudes out of the bore 27 of the first housing pin 23 into a coupling member 31 to the first gear 5, via which the rotary motion of the drive shaft 29 is transmitted to the gear 5.

Figure 5:
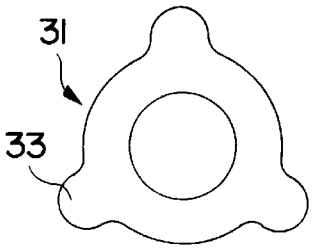
FIG. 5 is a single part representation of the coupling member from FIG. 2.

In the first exemplary embodiment, this coupling member, not shown in detail in FIG. 5, is embodied as a coupling disk 31, which is pressed with its radial interior wall onto the drive shaft 29 and preferably has three radially protruding formations 33 on its outer circumference. With these formations 33, the coupling disk protrudes onto corresponding recesses 35 on the interior wall face of the first gear 5, which is shown enlarged in FIGS. 3 and 4, and in this manner, produces a positive engagement connection between the coupling disk 31 and the first gear 5.

Figure 6:
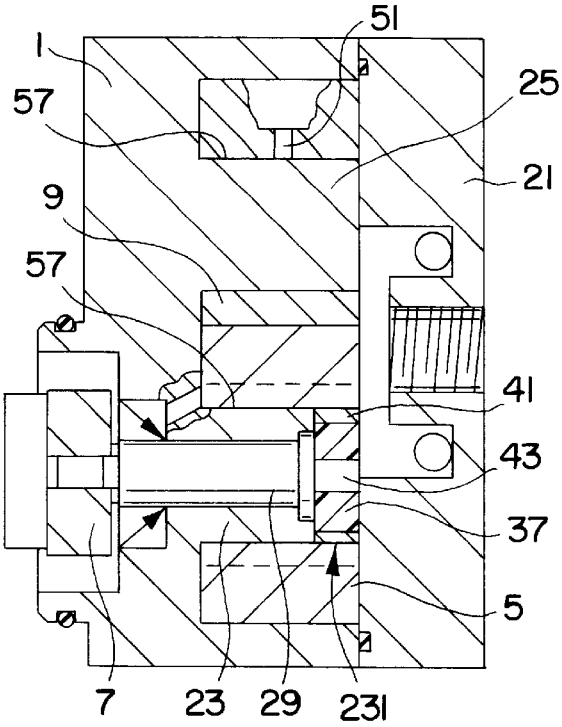
FIG. 6 is a second exemplary embodiment of the feed pump in which the coupling member is pressed into the interior wall of the gear.
Figure 7:
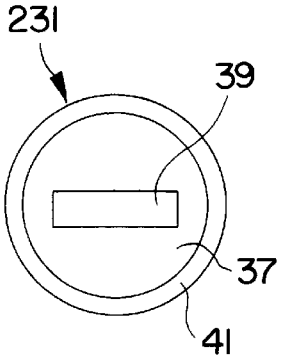
FIG. 7 is a single part representation of the coupling member from claim 6.

The second exemplary embodiment shown in FIGS. 6 and 7 differs from the first exemplary embodiment in the type of coupling member between the drive shaft 29 and the first gear 5.

The coupling disk 231 shown enlarged in FIG. 7 is now pressed with its outer circumference wall into the interior wall diameter of the first gear 5 on its side oriented toward the cover. The coupling disk 231 is comprised of a metal ring, preferably a steel ring 41, with a disk-shaped elastomer part 37 pressed into its interior. A preferably square or rectangular recess 39 is incorporated into this elastomer part 37 and a correspondingly shaped pin 43, which protrudes axially from the drive shaft 29, projects into this recess and thus produces a positive engagement connection between the coupling disk 231 and the drive shaft 29.

Figure 8:
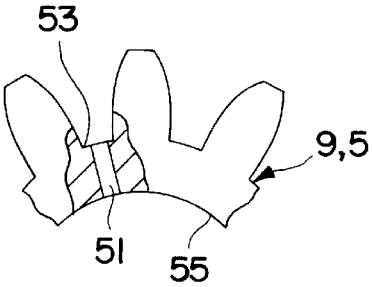
FIG. 8 is an enlarged detail from the gears of FIGS. 2 and 6, with a representation of the radial bore.

The lubrication of the bearing points of the gears 5, 9 on the housing pins 23, 25 is carried out by the feed medium, for which purpose a radial bore 51, as shown in FIGS. 6 and 8, is provided in both gears 5, 9, which starting from the base of the tooth 53, extends between two neighboring teeth of the gears 5, 9, to the interior wall 55 of the gears 5, 9, and in this way, supplies lubricant to the slide bearing points 57.

Figure 9:
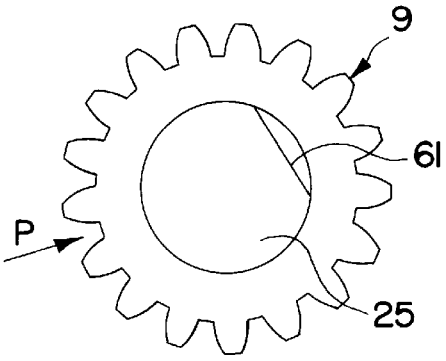
FIG. 9 shows a third exemplary embodiment in a simplified detail in the region of the connection of the gear and the housing bearing pin, in which a ground surface is provided on the housing pin.

In order to further improve the lubrication of the slide bearing points 57, in the third exemplary embodiment represented in a detail in FIG. 9, a flattening 61 is additionally provided on the housing pin 25 and is disposed on the end of the housing pin 25 remote from the pressure chamber 13 of the feed pump and lubricant can collect in this flattening.

Figure 10:
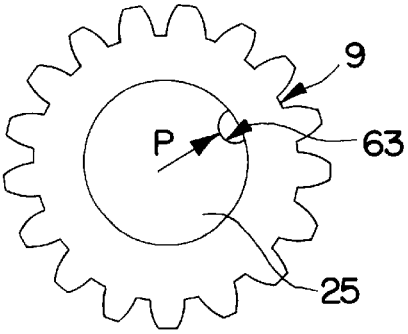
FIG. 10 shows a fourth exemplary embodiment analogous to the depiction in FIG. 9, in which a round groove is incorporated into the housing pin.

FIG. 10 shows a fourth exemplary embodiment analogous to FIG. 9, in which in lieu of the flattening 61, a round, groove-shaped recess 63 is disposed on the end of the housing pin 25 remote from the pressure chamber and lubricant can collect in this recess.

The first housing pin 23, which is embodied as a hollow axle, in a manner that is not shown in detail and is analogous to FIGS. 9 and 10, likewise has a flattening 61 or recess 63 on its pressure chamber end 11.

The feed pump according to the invention functions in the following manner. In the operation of the feed pump, the drive shaft 29 is preferably driven to rotate proportional to the speed of the engine to be fed. The drive shaft 29 transmits the rotary motion via the coupling member 31 (coupling disk 231) to the first gear 5, which in turn drives the second gear 9, which meshes with it, to rotate. As a result of the rotary motion of the gears 5, 9, which mesh with each other, the feed medium, preferably fuel, is fed from the intake chamber 11, along the supply conduits 15, and into the pressure chamber 13. In the intake chamber 11, a vacuum is produced which is sufficient to aspirate additional fuel from the storage tank via the intake line. The fuel pressure built up in the pressure chamber 13 produces a fuel supply via the outlet opening 19 into the supply line to the fuel injection pump.

With the embodiment of the support of the gears 5, 9 according to the invention, it is possible to introduce lateral forces acting on the gears 5, 9 directly into the housing 1 of the feed pump so that the drive shaft 29 only has to transmit the drive torque and an additional axle for supporting the second driven gear 9 can be eliminated.

The foregoing relates to preferred exemplary embodiments of the invention, it being understood that other variants and embodiments thereof are possible within the spirit and scope of the invention, the latter being defined by the appended claims.

We claim:

1. A feed pump comprising a housing (1), first and second gears (5,9) in said housing that mesh with each other and are driven to rotate in a pump chamber (3) in said housing, to supply a feed medium from an intake chamber (11) in said housing, connected to a storage tank, along a supply conduit (15) in said housing constituted between an end face of the first and second gears (5, 9) and a circumferential wall of the pump chamber (3), and into a pressure chamber (13), in which the first and second gears (5, 9) are each supported on first and second housing pins (23, 25) respectively, in which said first and second housing pins are embodied as being of one piece with the housing (1) of the feed pump and protruding into the housing (1), said first housing pin (23) has an axial through bore (27) into which a drive shaft (29) protrudes, the drive shaft (29) extends through and protrudes from the housing pin (23) on an end of said first housing pin (23) inside the housing and is connected in a non-rotating manner by means of a coupling member to said first gear (5) supported on the first housing pin (23), the drive shaft (29) is connected to the first gear (5) with positive engagement via the coupling member, the coupling member is embodied as a coupling disk (231) which is pressed with a circumference wall into an interior wall of the first gear (5) and has a slot-shaped recess (39) in an end wall disk (37) and a formed pin (43), which is corresponding shaped and protrudes axially from the drive shaft (29), and engages in the recess, and the end wall disk (37) that has the slot-shaped recess (39) comprises an elastic material which is inserted into a metal ring (41) pressed into the first gear (5).

2. A feed pump according to claim 1, in which the first and second gears (5, 9) have a radial bore (51) which feeds a fluid starting from a base of the tooth (53) between two neighboring teeth into a wall (55) defining an inside diameter of each said gear.

3. A feed pump according to claim 1, in which the housing pins (23, 25) have recesses (63) on their circumference wall.

4. A feed pump according to claim 1, in which the first and second housing pins (23, 25) have a flattened region (61) on their circumferential wall.

5. A feed pump according to claim 4, in which the flattened region (61) is disposed on an end of each of the first and second housing pins (23, 25) remote from the pressure chamber (13).

6. A feed pump according to claim 4, in which the recesses (63) are disposed on an end of each of the first and second housing pins (23, 25) remote from the pressure chamber (13).

* * * * *